US005305874A

United States Patent [19]

McLaughlin

[11] Patent Number: 5,305,874

[45] Date of Patent: Apr. 26, 1994

[54] SELF-PROTECTION CHEMICAL DISPENSER HOLDER

[76] Inventor: John H. McLaughlin, P.O. Box 420, Glidden, Iowa 51443

[21] Appl. No.: 43,562

[22] Filed: Apr. 7, 1993

[51] Int. Cl.[5] ..... A45C 11/32

[52] U.S. Cl. ..... 206/37; 206/37.1; 224/236; 224/239; 224/914

[58] Field of Search ..... 206/37, 38, 37.1; 224/235, 236, 239, 242, 241, 249, 246, 251, 252, 231, 911, 914; 70/456 R; 222/183

[56] References Cited

U.S. PATENT DOCUMENTS

| | | | |
|---|---|---|---|
| 668,382 | 2/1901 | Martin | 224/911 |
| 726,824 | 4/1903 | Phillips | 224/231 |
| 2,699,192 | 1/1955 | Poutinen . | |
| 2,812,606 | 11/1957 | Painter . | |
| 2,940,641 | 6/1960 | Norrish et al. . | |
| 3,286,751 | 11/1966 | Dishart . | |
| 3,445,046 | 5/1969 | Wilson | 224/241 |
| 3,484,023 | 12/1969 | Meshberg . | |
| 3,637,120 | 1/1972 | Clay . | |
| 4,143,798 | 3/1979 | Perkins | 224/911 |
| 4,220,263 | 9/1980 | Caruso . | |
| 4,303,185 | 12/1981 | Shoemaker | 224/911 |
| 4,479,596 | 10/1984 | Swanson | 224/236 |

OTHER PUBLICATIONS

Bucheimer Co. Catalog, Frederick, Maryland 21701, Jan., 1971.

Bucheimer Clark Catalog, Stanford/ Valencia, California 91355 Jan., 1973.

Ray O'Herron Co. Catalog, Danville, Ill. 61832, 1974.

Bucheimer Police Equipment Catalog, Frederick, Maryland 21701, Jan., 1974.

Safariland 1975 Catalog.

"Chemical Lance" Montgomery Ward Advertisement, Sentinel Star Orlando, Florida, Nov. 10, 1974.

George Stuart "Chemical Lance" Advertisement, Metro News, Nov. 28, 1974.

*Primary Examiner*—David T. Fidei

*Attorney, Agent, or Firm*—Henderson & Sturm

[57] ABSTRACT

An apparatus for carrying a self-protection chemical dispenser, functioning also as a key holder, which provides quick and convenient access to the dispenser nozzle while also protecting the nozzle from inadvertent activation. A protective arcuate portion or flap of the holder carries a rigid wire or semi-rigid strip of material which guards the nozzle while the device is in one's pocket or purse, or in case the device is accidentally dropped.

10 Claims, 4 Drawing Sheets

SELF-PROTECTION CHEMICAL DISPENSER HOLDER

TECHNICAL FIELD

This invention relates generally to an apparatus for holding a self-protection chemical dispenser which also functions as a key holder, and more particularly to such a device for preventing the dispenser from being accidentally fired.

BACKGROUND ART

As personal violence crimes have increased in recent years, dispensers have been developed which spray chemical irritants for use in defending potential victims from would-be attackers. Carrying cases for these dispensers have also been developed in an effort to make the dispensers more convenient to carry and to use. U.S. Pat. No. 4,220,263, which is incorporated herein by reference, is such a device, which was designed such that the dispenser could be discharged by pressing down on a retaining flap passing across the nozzle of the dispenser. While such a device provides a convenient method of discharging the chemical spray, it may also result in inadvertent activation of the dispenser, particularly when the device is carried in one's pocket or purse.

DISCLOSURE OF THE INVENTION

The present invention teaches an apparatus for conveniently carrying a self-protection chemical dispenser which allows for quick and convenient activation of the dispenser while also preventing the inadvertent activation of the dispenser as may occur when the device is dropped or carried in one's pocket or purse. The apparatus utilizes a rigid wire or strip of semi-rigid material situated within a portion of the holder passing over the dispenser actuator, which serves both to retain the dispenser within the holder and to prevent inadvertent dispenser activation.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
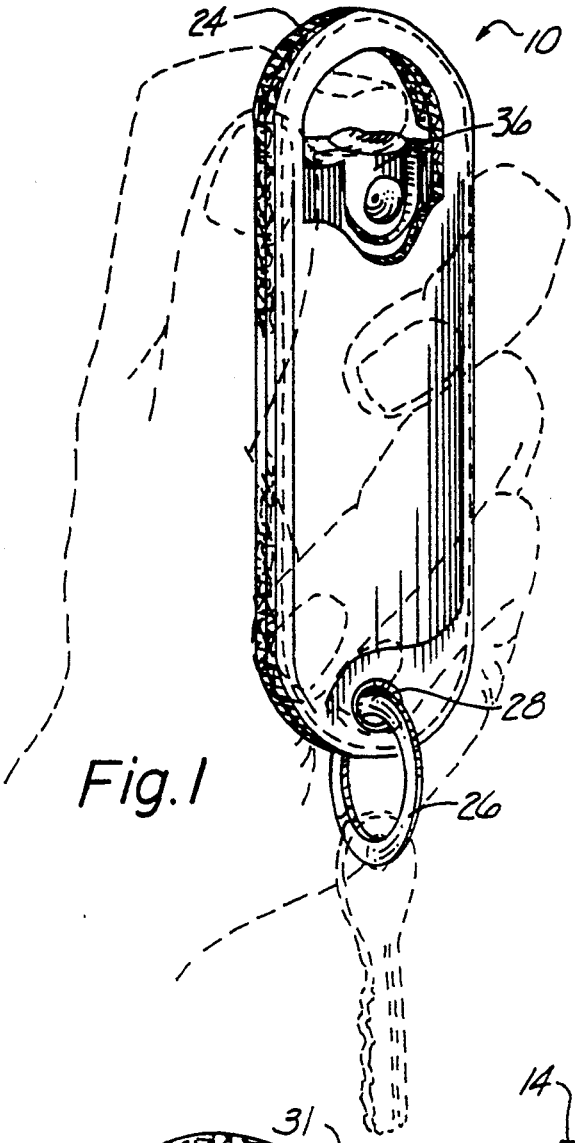
FIG. 1 is a perspective view of a preferred embodiment of the present invention in a user's hand.

Referring now to the drawings, wherein like reference numerals designate identical or corresponding parts throughout the several views, a preferred embodiment of the invention is depicted in FIGS. 1 through 5. The apparatus 10 comprises a front section 12 and a rear section 14, fabricated from panels of leather, vinyl, or other material offering similar physical characteristics. These two panels are fastened together along their periphery, preferably by stitching, although other methods such as gluing or riveting may also be effective. The panels are fastened together in such a manner as to form a housing having a tubular configuration, with the interior 20 of the housing of a size to accept a cylindrical chemical dispenser with a reasonably snug fit. The relatively inflexible nature of leather or vinyl will also contribute to a more snug fit such that the dispenser will be held quite securely within the housing. The dispenser is of a type shown in U.S. Pat. No. 3,484,023 to Meshberg, which is incorporated herein by reference.

Figure 2:
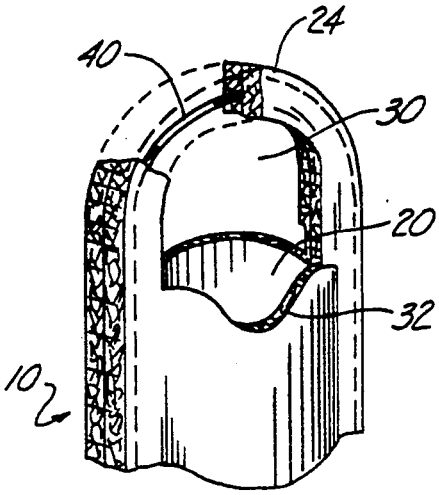
FIG. 2 is a perspective view in partial section of the top of the preferred embodiment.
Figure 5:
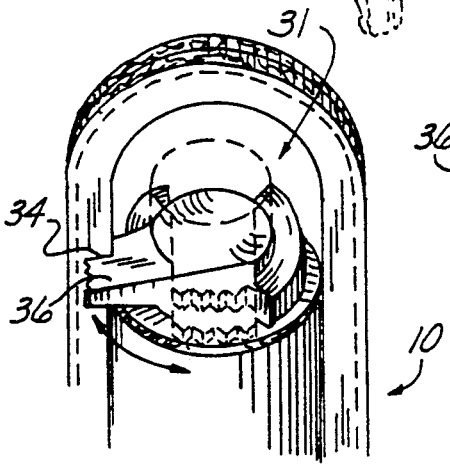
FIG. 5 is a perspective view of the rear of the preferred embodiment.
Figure 4:
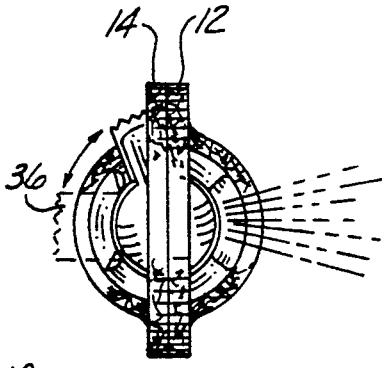
FIG. 4 is a top view of the preferred embodiment.
Figure 3:
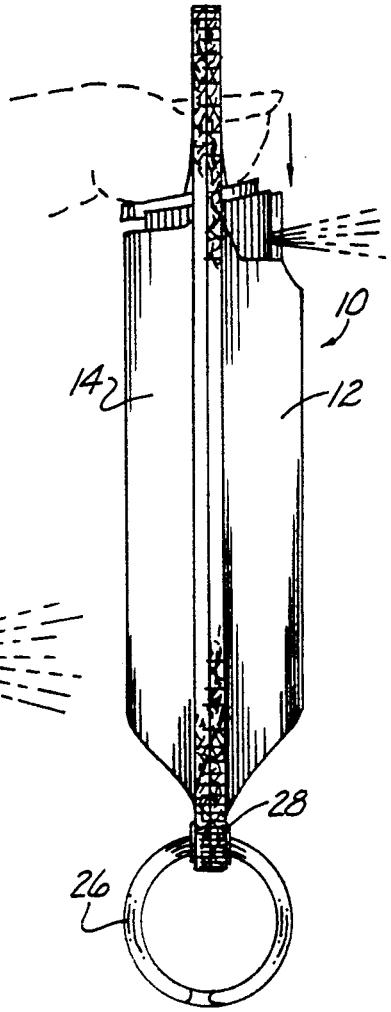
FIG. 3 is a side elevation view of the preferred embodiment with the dispenser being actuated.
Figure 6:
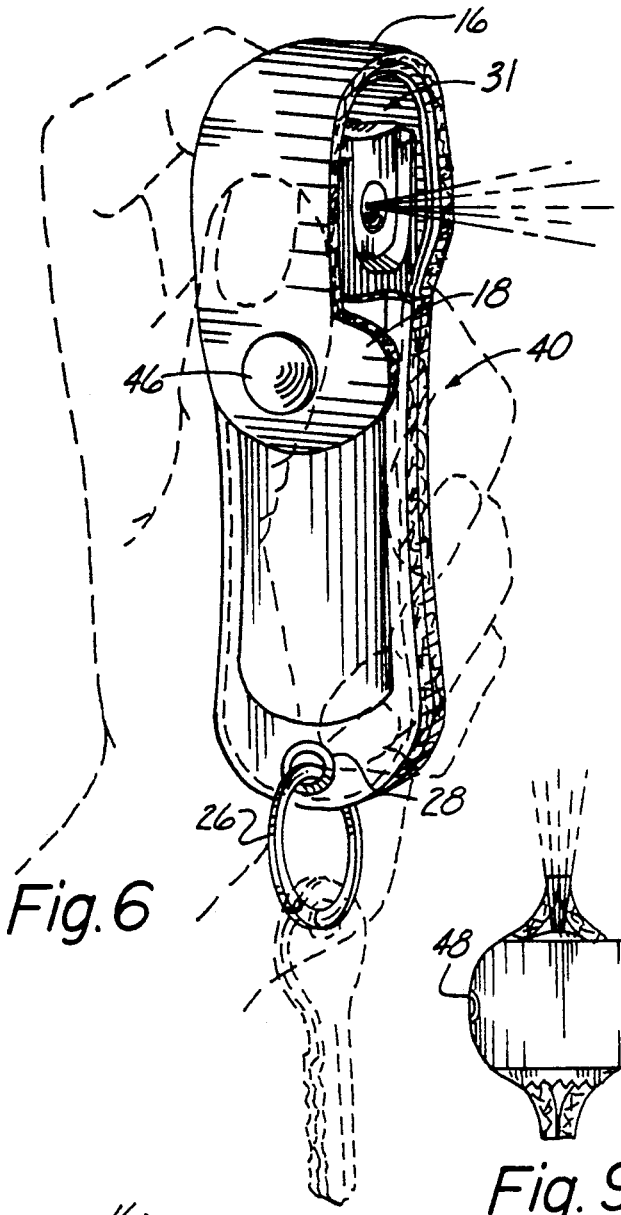
FIG. 6 is a perspective view of a second embodiment of the present invention in actual use.
Figure 7:
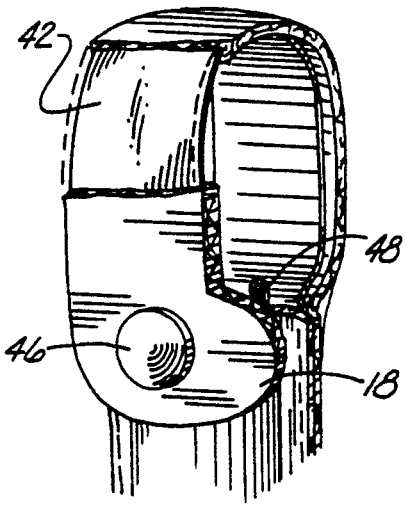
FIG. 7 is a perspective view in partial section of the top of a second embodiment.
Figure 9:
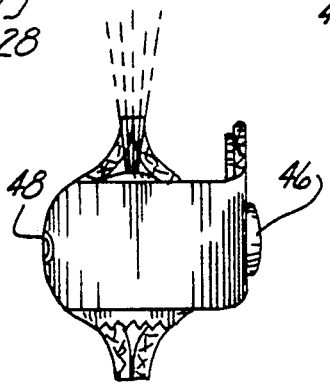
FIG. 9 is a top view of a second embodiment.
Figure 8:
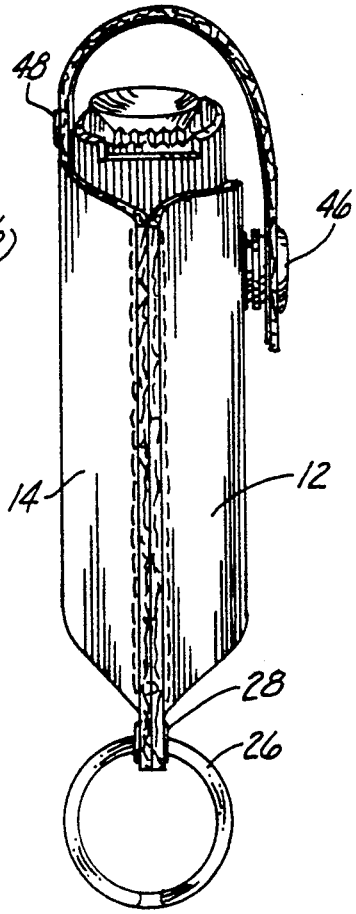
FIG. 8 is a side elevation view of a second embodiment.
Figure 10:
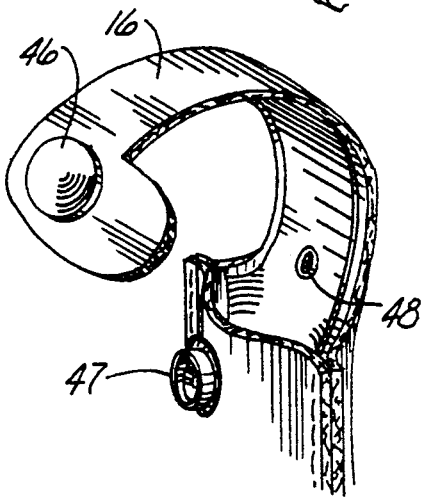
FIG. 10 is a perspective view of a second embodiment with the retainer flap in the open position and the dispenser removed.

The front and rear sections each have an aperture 30 cut within them, thereby providing access to the nozzle assembly of the chemical dispenser and also providing an opening through which the chemical is sprayed. The arcuate portion 24 of the housing functions to help retain the dispenser within the apparatus, prevent loss of the dispenser nozzle and to prevent unintentional firing of the device. As best seen in FIG. 2, the aperture in the front panel may be of a slightly different shape than that of the rear panel, having a cutout 32 in the lower edge of the aperture to ensure that none of the chemical spray is blocked by any portion of the front panel. Also, as seen in FIG. 5, the rear panel may have a notch 34 cut into a lower corner of the rear aperture thereby ensuring that the swivel nozzle 36 of the dispenser may be rotated completely to the safety position.

Fitted between the front and rear sections, and held in place by the stitching which fastens the sections together, is a loop of rigid wire 40 which travels about the interior of the housing adjacent the stitching. This rigid wire 40 performs the function of providing sufficient rigidity to the arcuate portion 24 of the housing so as to prevent inadvertent actuation of the dispenser as may occur if the device is dropped or when it is carried in one's pocket or purse. The invention may be utilized as a key holder by the insertion of a key ring 26 through an aperture 28 passing through the lower end of the housing.

A second embodiment 40 of the present invention is depicted in FIGS. 6 through 10, wherein a flap 16 is formed as an extension of rear section 14 and which extends across the top of the chemical dispenser and is then fastened to the front section 12 by means of a snap fastener 46 or other fastening means such as a hook and loop fastener. It may be seen that sufficient space is provided between the flap 16 and the dispenser nozzle so as to provide easy access to the nozzle for firing with the flap remaining in the secured position. Attached beneath the flap 16 is a strip 42 of semi-rigid plastic or resilient metal such as spring steel, which serves the same function as did the rigid wire 40 of the previous embodiment in that it prevents inadvertent activation of the dispenser while also securing the dispenser within the holder and preventing loss of the nozzle should it become dislodged from the dispenser. The strip 42 may be secured to the flap 16 by means of a rivet 48 and the snap fastener 46 and 47. The flap 16 is cut with a protrusion 18 extending laterally therefrom adjacent the fastener 46 which greatly aids in releasing the fastener 46 and raising the flap 16.

Figure 11:
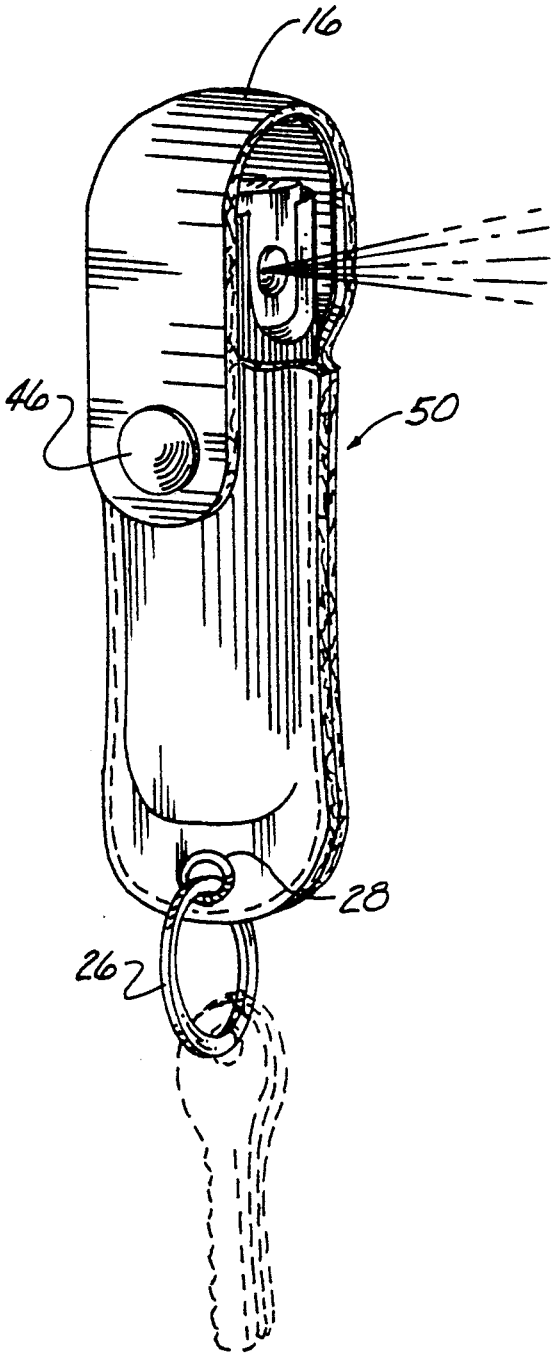
FIG. 11 is a perspective view of a third embodiment.
Figure 12:
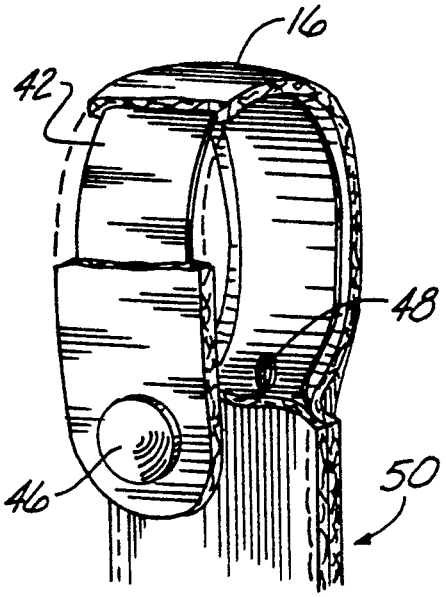
FIG. 12 is a perspective view in partial section of the top of a third embodiment.

A third embodiment 50 of the present invention is depicted in FIGS. 11 and 12, which is identical to the second embodiment, but is not configured with the protrusion 18 extending laterally from the flap 16.

A user can easily access the protrusion 18 with the user's thumb to flip open the flap and quickly fire the canister 31. The semi-rigid member 42 will cause the flap 16 to automatically open to at least the position shown in FIG. 10 when the snap 46 is unsnapped.

Figure 13:
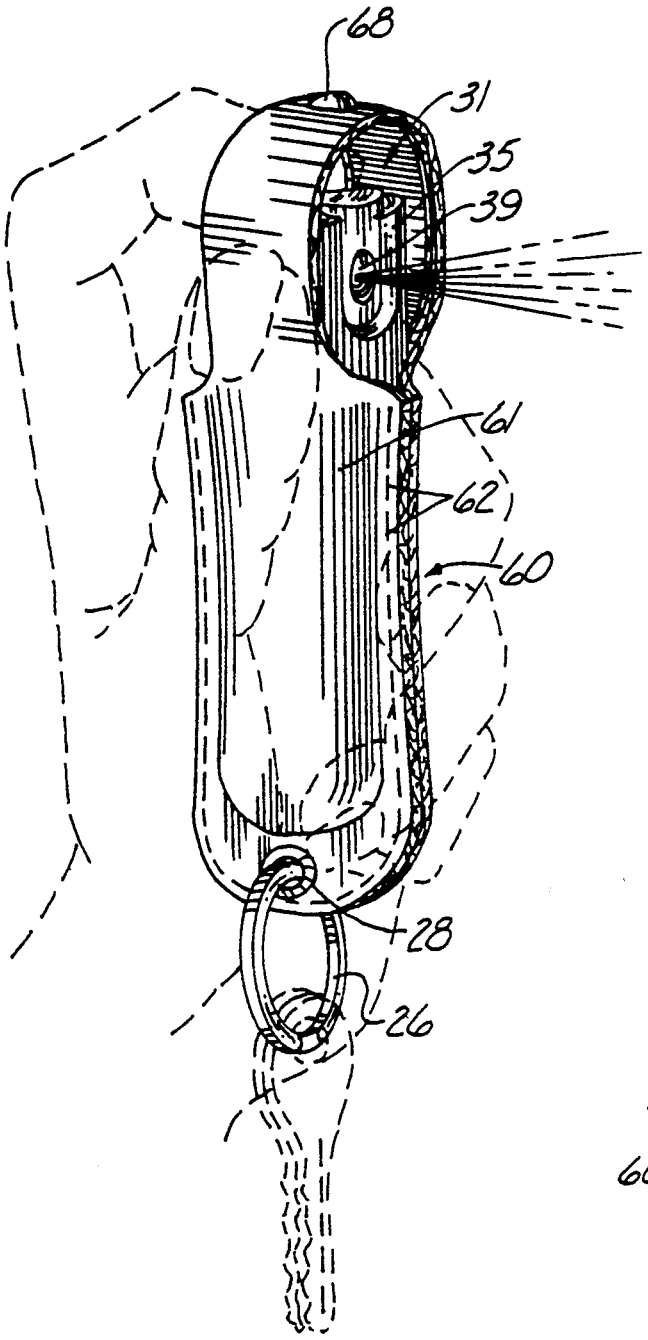
FIG. 13 is a perspective view of a fourth embodiment of the present invention in the process of being fired.
Figure 14:
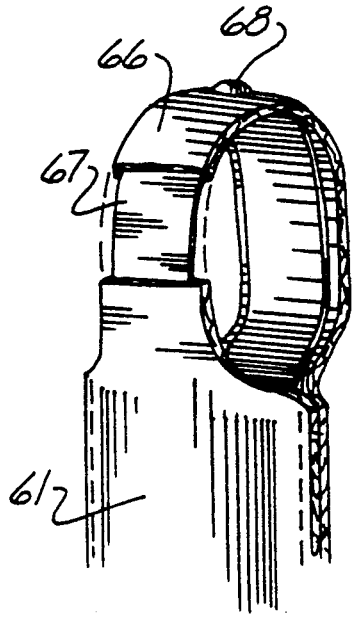
FIG. 14 is a perspective view of a top portion of the empty case of FIG. 13 with a portion of the top flap broken away to show a metal or semi-rigid plastic strap.
Figure 15:
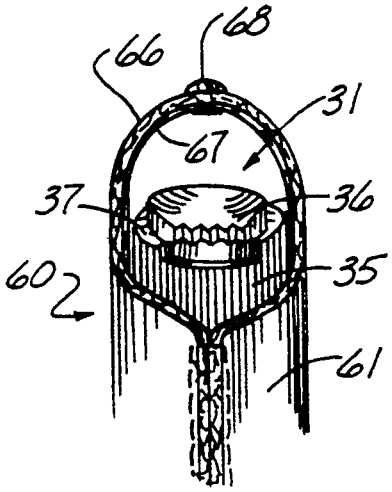
FIG. 15 is a rear view of the top portion of the device shown in FIG. 13.

A fourth embodiment 60 is shown in FIGS. 13, 14 and 15. The holster is formed of one piece of flexible leather or vinyl 61 sewn together at the edges by stitches 62. Top flap 66 has a spring steel or semi-rigid plastic strip 67 attached thereto by rivet 68. The strip 67 extends downwardly past the top portion 35 of canister 31 so that the ends of strip 67 will not snag on the top of portion 35. This will cause the ends of strip 67 to remain on the sides of portion 35 of the canister 31 even if the top 66 is pushed down. Consequently, a space is always maintained between the strip 67 and the actuator button 36 so that pushing on the top of flap 66 cannot fire the canister 31. The canister can be fired as shown in FIG. 13 whereby the button is rotated off of the locking shoulder 37 to the position shown in FIG. 15 and the index finger is used to depress button 36 to spray mace or the like out of nozzle 39.

Thus it may be seen that the present invention offers a convenient apparatus for carrying a self-protection chemical dispenser, particularly when used as a key holder. The invention allows quick access to the spray nozzle for immediate activation of the dispenser should a person come under attack, but also prevents accidental activation of the dispenser.

Obviously, many modifications and variations of the present invention are possible in light of the above teachings. It is therefore to be understood that, within the scope of the appended claims, the invention may be practiced otherwise than as specifically described.

I claim:

1. A carrying case for use in combination with a self-protection chemical dispenser having a cylindrical body equipped with a spray nozzle and an actuator button wherein the carrying case comprises:

a front section and a rear section, said front section being fastened to said rear section along at least a portion of its periphery, wherein, whereby a generally cylindrical tubular housing is formed capable of holding the chemical dispenser therein, said tubular housing having a first end and a second end, said second end being closed, said first end having an enlarged retention means forming an enlarged generally arcuate loop for retaining the dispenser within said housing, wherein, the top of the actuator button is spaced a substantial distance from the apex of said arcuate loop to accommodate the insertion of a users finger intermediate the said arcuate loop and the top of said actuator button, and protective means associated with said arcuate loop and associated with said arcuate loop and extending over the top and along both sides of said actuator button for preventing the inadvertent activation of the spray nozzle of the chemical dispenser.

2. A carrying case for use in combination with a self-protection chemical dispenser having a cylindrical body equipped with a spray nozzle and an actuator button, wherein, the carrying case comprises:

a one-piece body, including a front section and a rear section, said front section being joined to said rear section along a portion of its periphery in a flat co-facing relationship; wherein, a generally cylindrical tubular housing is formed capable of holding the chemical dispenser therein, said tubular housing having a first end and a second end, said second end being closed, said first end having an enlarged retention means forming a generally arcuate loop for retaining the dispenser within said housing, wherein, the top of the actuator button is spaced a substantial distance from the apex of said arcuate loop to accommodate the insertion of a users finger intermediate the said arcuate loop and the top of said actuator button, and protective means associated with said arcuate loop and extending over the top and along both sides of said actuator button for preventing the inadvertent activation of the spray nozzle of the chemical dispenser.

3. A carrying case for use in combination with a self-protection chemical dispenser having a cylindrical body equipped with a spray nozzle and an actuator button, wherein, the carrying case comprises:

a front section and a rear section, said front section being fastened to said rear section along its entire periphery in a flat co-facing relationship, wherein, a generally cylindrical tubular housing is formed capable of holding the chemical dispenser therein, said tubular housing having a first end and a second end, said second end being closed, said first end having an enlarged retention means forming an enlarged generally arcuate loop for retaining the dispenser within said housing, wherein, the top of the actuator button is spaced a substantial distance form the apex of said arcuate loop to accommodate the insertion of a users finger intermediate the said arcuate loop and the top of said actuator button, and protective means associated with said arcuate loop and extending over the top along both sides of said actuator button for preventing the inadvertent activation of the spray nozzle of the chemical dispenser.

4. The carrying case as recited in claim 3, wherein, said protective means comprises a rigid wire disposed intermediate the said front and rear sections and passing through said retention means, thereby preventing said retention means from pressing upon the actuator button on the spray nozzle.

5. The carrying case as recited in claim 1, wherein said retention means comprises an arcuate extension of said front section and said rear section, said extension created by forming an aperture through said front section and said rear section near said first end, said aperture providing access to the spray nozzle of the dispenser.

6. The carrying case as recited in claim 5, wherein said protective means comprises a rigid wire passing through said retention means, thereby preventing said retention means from pressing upon the actuator button or the actuator button or the spray nozzle.

7. The apparatus of claim 6 including a notch in the rear section of said cylindrical body for receiving a portion of an actuating cap of the dispenser in a locking mode.

8. The carrying case as recited in claim 1, wherein said retention means comprises an extension of said rear section, said extension forming a flap which passes across said first end and is secured to said front section thereby retaining the dispenser within the housing while providing access to the spray nozzle of the dispenser.

9. The carrying case as recited in claim 7, wherein said protective means comprises a strip of semi-rigid material secured to said flap passing across said first end, thereby preventing said flap from pressing upon the spray nozzle.

10. The carrying case of claim 9 including snap means for holding said flap closed and when released, permitting said strip of semi-rigid material to automatically lift the flap open.

* * * * *